US005578144A

United States Patent [19]

Satou et al.

[11] Patent Number: 5,578,144

[45] Date of Patent: Nov. 26, 1996

[54] HIGH-STRENGTH, HIGH-DUCTILITY CAST ALUMINUM ALLOY AND PROCESS FOR PRODUCING THE SAME

[75] Inventors: Kazuaki Satou, Brookline, Mass.; Yukio Okochi, Susono, Japan

[73] Assignee: Toyota Jidosha Kabushiki Kaisha, Toyota, Japan

[21] Appl. No.: 490,450

[22] Filed: Jun. 14, 1995

[30] Foreign Application Priority Data

Jul. 19, 1994 [JP] Japan ..... 6-166800

[51] Int. Cl.[6] ..... C22C 21/00

[52] U.S. Cl. ..... 148/415; 148/549; 148/416; 148/417; 148/418; 148/437; 148/438; 148/439; 148/440; 420/528; 420/529; 420/535; 420/542; 420/544; 420/545; 420/548; 420/549; 420/550; 420/551; 420/552; 420/553; 420/590

[58] Field of Search ..... 148/549, 415, 148/416, 417, 418, 437, 438, 439, 440; 420/528, 529, 535, 542, 544, 545, 548, 549, 550, 551, 552, 553, 590

[56] References Cited

U.S. PATENT DOCUMENTS 5,431,751 7/1995 Okochi et al. ..... 148/549

FOREIGN PATENT DOCUMENTS 1-275732 11/1989 Japan .
5-331584 12/1993 Japan .

OTHER PUBLICATIONS

Mahasan, et al., "Rapidly Solidified Microstructure of Al–8Fe–4 Lanthanide Alloys", Journal of Materials Science, 22(1), 1987; pp. 202–206.

*Primary Examiner*—Melvyn Andrews
*Assistant Examiner*—Robert R. Koehler
*Attorney, Agent, or Firm*—Oblon, Spivak, McClelland, Maier & Neustadt, P.C.

[57] ABSTRACT

To provide a high-strength, high-ductility cast aluminum alloy, which enables a near-net shape product to be produced by improving the casting structure of an aluminum alloy, particularly by using specific constituents and controlling the cooling rate, and a process for producing the same. The high-strength, high-ductility cast aluminum alloy of the present invention is characterized in that it has a structure comprising fine grains of α-Al, having an average grain diameter of not more than 10 μm, surrounded by a network of a compound of Al-lanthanide-base metal, the α-Al grains forming a domain, that the domain comprises an aggregate of α-Al grains which have been refined, cleaved, and ordered in a single direction and that it has a composition represented by the general formula $Al_aLn_bM_c$ wherein a, b, and c are, in terms of by weight, respectively $75\% \leqq a \leqq 95\%$, $0.5\% \leqq b < 15\%$, and $0.5\% \leqq c < 15\%$.

4 Claims, 4 Drawing Sheets

HIGH-STRENGTH, HIGH-DUCTILITY CAST ALUMINUM ALLOY AND PROCESS FOR PRODUCING THE SAME

BACKGROUND OF THE INVENTION

1. Field of the Invention

The present invention relates to a high-strength, high-ductility cast aluminum alloy, which enables a near-net shape product to be produced through an improvement in the structure of a cast aluminum alloy, particularly through the use of specific constituents and the control of a cooling rate, and a process for producing the same.

2. Prior Art

In the case of a rapidly solidified Al alloy, the mechanical properties thereof are greatly influenced by grain shape and size. In recent years, this has led to development with attention to the cooling rate. In this case, the important properties required of Al alloys, as a structural material, are strength and ductility. These properties are, however, generally contradictory, and it has been regarded as difficult to simultaneously attain high levels of both properties.

Specifically, in the rapid solidification process, strengthening by taking advantage of precipitates of crystals is effective for increasing the strength. This, however, generally results in remarkably lowered ductility. Representative high-strength Al alloys include, for example, an alloy prepared by powder metallurgy as disclosed in Japanese Unexamined Patent Publication (Kokai) No. 1-275732. The properties of this alloy have a tendency although the strength is increased, to lower the ductility.

For the high-strength Al alloy prepared by powder metallurgy, the elongation is usually not more than several percent, and the elongation of an Al alloy, having a high Si content, prepared by powder metallurgy is 1 to 2% at the highest.

Further, for powder metallurgy, the cost for the preparation of a powder is high, in addition, the steps of bulk production, forming and the like, are necessary for commercialization, which naturally results in an increased cost.

On the other hand, an elongative material has the best-balanced properties in respect to strength and ductility. In recent years, however, no significant improvement in the properties of this material has yet been attained. In order to develop superior properties, thermomechanical treatment and other processes should be made, which are likely to increase the cost of production.

For this reason, an enhancement of the strength and ductility of a low-cost cast material to the level of those of the elongative materials is most desirable. However, the cast material, which seems to be the lowest-cost material, suffers from a problem in that the strength is much lower than that of the materials prepared by the rapid solidification process and the powder metallurgy process for the following reasons.

At the outset, in the case of the most common and effective precipitation (dispersion) strengthening, in order to provide strength, a larger amount of a strengthening phase of crystal or precipitate should be produced homogeneously and finely. However, the strengthening phase is fragile, and, in addition, the interface of the strengthening phase and the Al matrix is likely to fracture, resulting in lowered ductility. For this reason, strength should be sacrificed in order to ensure the desired ductility.

The sole method that seems to enable both the strength and ductility to be improved is strengthening by refining the structure. In order to attain a distinguishable improvement in the properties, the refinement should be significant. This requires a very high cooling rate. Eventually, the above method should rely on the powder metallurgy process, which, as described above, results in a very high production cost.

SUMMARY OF THE INVENTION

An object of the present invention is to provide a high-strength, high-ductility cast aluminum alloy, which is a cast material, necessitates no thermomechanical treatment and has a good balance between strength and ductility on a level comparable to that of an elongative material, by developing a unique compound phase by liquisol quenching the above aluminum alloy and studying the formation of an optimal composite phase of the unique compound phase and an Al phase.

Another object of the present invention, in view of the fact that the conventional rapid solidification process and powder metallurgy require a very high cooling rate, is to provide a process for producing a high-strength, high-ductility cast aluminum alloy, which has a reduced production cost, by taking advantage of optimal alloy constituents and cooling rate and by studying the ordering of Al grains and coherency with the compound phase.

The above object can be attained by a high-strength, high-ductility cast aluminum alloy, and process for producing the same mentioned as the following.

(1) A high-strength, high-ductility cast aluminum alloy, characterized by having a structure comprising fine grains of α-Al, having an average grain diameter of not more than 10 μm, surrounded by a network of a compound of Al-lanthanide-base metal, said α-Al grains forming a domain.

(2) The high-strength, high-ductility cast aluminum alloy according to item (1), wherein said domain comprises an aggregate of α-Al grains which have been refined, cleaved, and ordered in a single direction.

(3) A high-strength, high-ductility cast aluminum alloy characterized by having a composition represented by the general formula $Al_aLn_bM_c$ wherein Ln is at least one metallic element selected from Y, La, Ce, Sm, Nd, Hf, Nb, and Ta, M is at least one metallic element selected from V, Cr, Mn, Fe, Co, Ni, Cu, Zr, Ti, Mo, W, Ca, Li, Mg, and Si and a, b, and c are, in terms of by weight, respectively $75\% \leqq a \leqq 95\%$, $0.5\% \leqq b < 15\%$, and $0.5\% \leqq c < 15\%$, said alloy having a structure comprising fine grains of α-Al, having an average grain diameter of not more than 10 μm, and an ultrafine compound of Al-lanthanide-base metal having an average grain diameter of not more than 1 μm, said α-Al grains being surrounded by a network of said Al-lanthanide-base metal compound and forming a domain.

(4) A process for producing a high-strength, high-ductility cast aluminum alloy, characterized by comprising the steps of: melting an aluminum alloy, according to item (3), represented by the general formula $Al_aLn_bM_c$; and casting the melt into a desired shape at a cooling rate of not less than 150° C./sec.

DESCRIPTION OF THE PREFERRED EMBODIMENT

Figure 1:
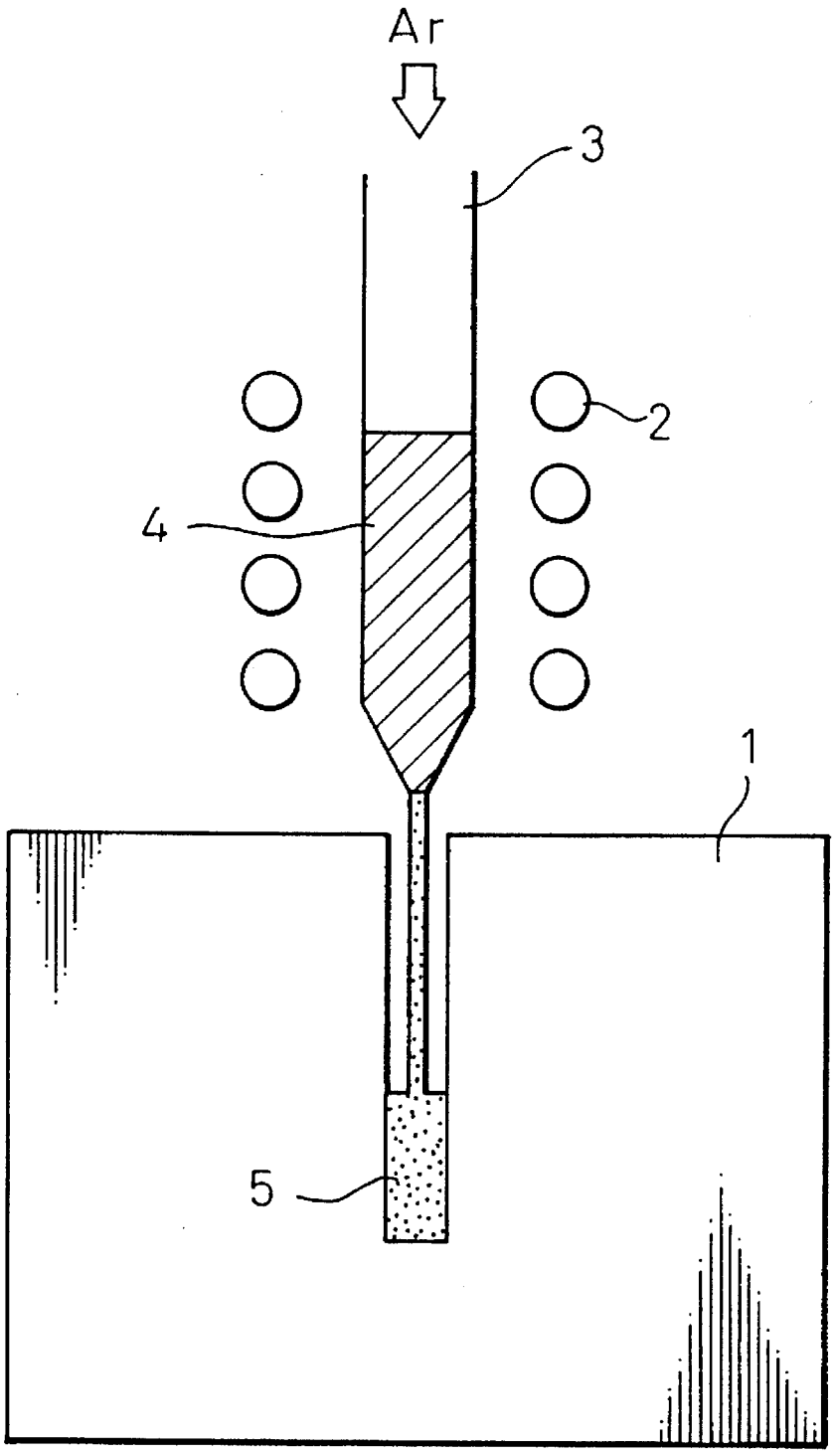
FIG. 1 is a schematic diagram showing an embodiment of a device for carrying out the present invention.

In the material of the present invention, the high strength and high ductility are derived from the following mechanism which is attributable to a particular fine double phase structure. Specifically, they can be attained by ① solid solution strengthening and refinement of the α-Al phase, ② refinement by cleaving precipitates of the α-Al phase, and ③ strengthening by a combination of the α-Al phase with a precipitated compound phase. Further, regarding the function of additive elements of the present invention, the Ln element, by virtue of its large atomic radius, accelerates solid solution strengthening of α-Al phase by the size effect and, at the same time, accelerates nonequilibration of the compound. On the other hand, as in the case of the conventional Al alloy, the M element has the effect of refinement and the effect of improving the strength.

The technical feature of the present invention is to attain the formation of a double phase structure of refined and cleaved α-Al grains and an Al-Ln-M compound. When the average diameter of the α-Al grains exceeds 10 μm, no grain refinement effect can be attained, resulting in unsatisfactory strength and ductility. When the average grain diameter of the compound of Al-Ln-M exceeds 1 μm, the refinement effect attained by fine precipitation at subgrain boundaries is lowered, making it impossible to ensure the strength and ductility contemplated in the present invention.

The most important technical feature of the present invention is that, by taking advantage of the mutual effect of the above elements, cooling rate, and additive elements (amount), the periphery of the fine α-Al grains is surrounded by the Al-Ln-M compound in a network manner and, at the same time, the α-Al grains form a domain. The precipitation occurs at a very high speed from a supersaturated state along the subgrains, and since the orientation is kept identical to the original orientation, the ordering occurs in a very long range, forming a domain having a network structure.

When the amount of the added metallic elements, i.e., Ln and M, is less than 0.5% by weight or not less than 15% by weight, it becomes difficult for the compound to surround the fine α-Al grains in a network manner and to exist as a nonequilibrium phase. Ln is preferably "Mm (misch metal)" which is a mixed alloy of lanthanide elements. This is more advantageous from the viewpoint of the production cost.

When the cooling rate is less than 150° C./sec, it becomes difficult to instantaneously form precipitates from the supersaturated state. That is, the development of a high energy state at subgrain boundaries becomes impossible, making it impossible to form a stable nonequilibrium phase. In the conventional casting system on a commercial scale, the upper limit of the cooling rate is about 300° C./sec.

By virtue of a unique fine double phase structure wherein the periphery of α-Al grains is surrounded by an Al-lanthanide-base metal compound (Al-Ln-M compound) in a network manner, the cast aluminum alloy of the present invention, despite being a cast material, has a tensile strength and an elongation equal to or higher than elongative materials.

Further, in the present invention, when an Al alloy having a specific composition is produced at a specific cooling rate, crystallization or precipitation of an ultrafine compound having a composition of Al-Ln-M occurs in a network manner at the subgrain boundaries in α-Al grains. It is considered that precipitation occurs within the domain. At the present time, however, it is impossible to judge whether the intergranular layer in the periphery of the domain is formed by crystallization or precipitation. However, by virtue of the above phenomenon, the grain structure is so markedly refined that even the as-cast alloy has high strength and elongation.

The present invention will now be described in more detail with reference to the following examples and comparative examples.

EXAMPLES

Cast materials as examples of the present invention were prepared by the following production process. Raw materials, which have been weighed so as to give predetermined compositions specified in Table 1, were melted in an arc melting furnace to prepare mother alloys. FIG. 1 is a schematic diagram showing an apparatus for carrying out the invention. In this apparatus the mother alloy, thus prepared, is placed in quartz nozzle 3 and melted by means of high frequency coil 2 to prepare a molten alloy 4 which is cast from the tip of the quartz nozzle 3 into a copper mold 1.

In the present examples the mother alloy was cut into a suitable size, inserted into the quartz nozzle 3 (shown in FIG. 1), and melted by a high-frequency melting process. After the completion of the melting, the melted mother alloy was poured into the pure copper mold 1, by taking advantage of the back pressure of Ar gas, to prepare cast material 5 (other inert gases may be used instead of the Ar gas).

In the present examples, the temperature of the molten metal was not measured. Excessive heating causes a reaction between the quartz nozzle and the molten alloy, so that there is a possibility that the resultant cast material has a composition different from the contemplated composition. In the present examples, conditions for the high frequency apparatus and the holding time after melting were kept constant, and it was confirmed by a chemical analysis that no reaction between the nozzle and the molten metal occurred under these conditions.

TABLE 1

| No. | Composition (wt %) | Diameter of mold: 10 mm Tensile strength (MPa) | Elongation (%) | Hardness (Hv) | Diameter of mold: 6 mm Tensile strength (MPa) | Elongation (%) | Hardness (Hv) | Diameter of mold: 4 mm Tensile strength (MPa) | Elongation (%) | Hardness (Hv) |
|---|---|---|---|---|---|---|---|---|---|---|
| Ex. | | | | | | | | | | |
| 1 | Al-4Mm-4Fe | 256 | 18 | 87 | 453 | 25 | 145 | 492 | 28 | 176 |
| 2 | Al-6Mm-4Fe | 324 | 13 | 101 | 492 | 20 | 155 | 520 | 28 | 192 |
| 3 | Al-6Mm-6Fe | 352 | 7 | 127 | 570 | 19 | 180 | 603 | 25 | 186 |
| 4 | Al-12Mm-4Fe | 404 | 4 | 149 | 546 | 17 | 172 | 594 | 20 | 177 |
| 5 | Al-6Mm-6Ti | 322 | 8 | 117 | 532 | 16 | 180 | 587 | 17 | 179 |
| 6 | Al-6Mm-6Mn | 376 | 6 | 121 | 476 | 17 | 177 | 546 | 20 | 195 |
| 7 | Al-6Mm-6Zr | 329 | 11 | 128 | 510 | 16 | 174 | 557 | 19 | 186 |
| 8 | Al-6Mm-6Ni | 377 | 11 | 130 | 499 | 19 | 162 | 530 | 21 | 169 |
| Comp. Ex. | | | | | | | | | | |
| 11 | Al-15Mm-4Fe | 324 | 3 | 133 | 355 | 6 | 145 | 375 | 5 | 143 |
| 12 | Al-4Mm-15Fe | 296 | 2 | 146 | 323 | 3 | 149 | 350 | 3 | 153 |
| 13 | Composition of 7075 alloy | 378 | 11 | 117 | 375 | 8 | 124 | 390 | 6 | 128 |
| 14 | Composition of ACIB alloy | 333 | 15 | 91.7 | 350 | 12 | 102 | 340 | 12 | 107 |

Further, in order to prevent the occurrence of defects in a cast material due to the oxidation of the cast material and the entrainment of a gas, the melting and casting were carried out in a chamber with a vacuum atmosphere such that, after evacuation to a level of $10^{-3}$ Pa, a high-purity Ar gas (99.99%) was introduced to $3\times10^4$ Pa.

The diameter of the hole provided at the tip of the nozzle for ejecting the molten metal was 0.3 mm, and the ejection pressure was $1.8\times10^5$ Pa.

The mold was made of pure copper, and cylindrical cast materials respectively having sizes of diameter: 10 mm×length: 50 mm, 6 mm×50 mm and 4 mm×50 mm were prepared for each composition. The cooling rate determined from a change in molten metal temperature in the mold under the above casting conditions was 149° C./sec for diameter: 10 mm and 350° C./sec for diameter: 4 mm.

The cooling rate for diameter: 6 mm could not be determined by the restriction of the apparatus.

The mechanical properties of the cast materials were evaluated by the following test under the following conditions.

| | |
|---|---|
| Tensile test (Instron Tester): | parallel portion: diameter: 2 mm × length: 10 mm<br>crosshead speed: 1 mm/min<br>n = 7 |
| Measurement of Vickers hardness: | load 5 kgf |

The structure was analyzed by X-ray diffractometry and observation under a transmission electron microscope (including EDX).

The test results are given as the mechanical properties in Table 1. The tensile strength and the elongation of the cast materials of Example Nos. 1 to 8, wherein the composition and cooling rate (diameter: 6, 4 mm) fall within the scope of claim for patent of the present application, were about twice those of the conventional cast material*. (*JIS-AC7B-T6 material: tensile strength 294 MPa, elongation 10%) The balance between the tensile strength and the elongation is equal to or better than that of extra super duralumin known as a high-strength elongative material (JIS-7075-T6 material: 574 MPa, 11%).

It should be particularly noted that the material of the present invention has properties given in Table 1 even in F material which has been subjected to no thermomechanical treatment. (*, **: Metals Handbook, revised 5th edition, edited by The Japan Institute of Metals)

In general, the strength of a metal alloy is likely to increase with increasing the cooling rate. However, that the high strength property of the material of the present invention is not derived merely from high cooling rate is apparent from the results of Comparative Example Nos. 11 to 14. These results are those for cast materials which were produced in the same manner as in the examples of the present invention except that the compositions were outside the composition range specified in the scope of the claim for patent of present invention. For Comparative Example Nos. 11 and 12, although the composition system is equal to that of the examples of the present invention, the percentage compositions are different from that specified in the scope of the claim for patent of the present application.

Figure 2:
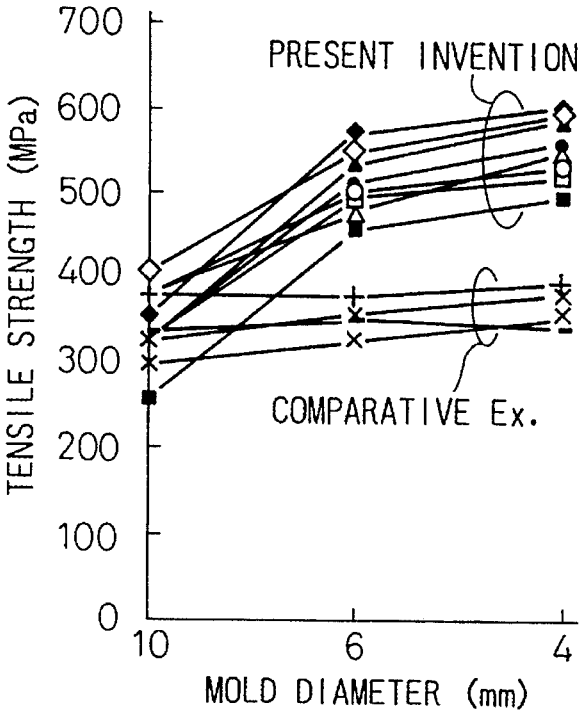
FIG. 2 is a diagram showing the relationship between the mold diameter and the tensile strength according to the present invention.
Figure 3:
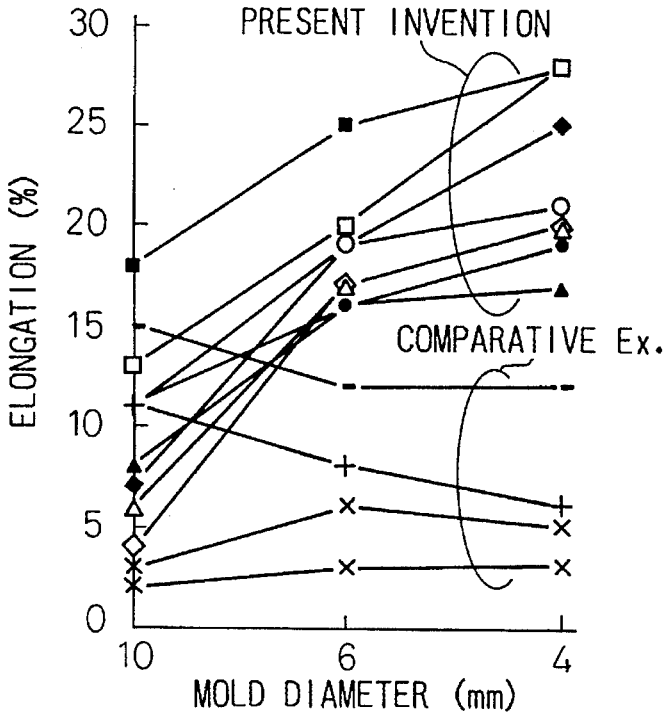
FIG. 3 is a diagram showing the relationship between the mold diameter and the elongation according to the present invention.
Figure 4:
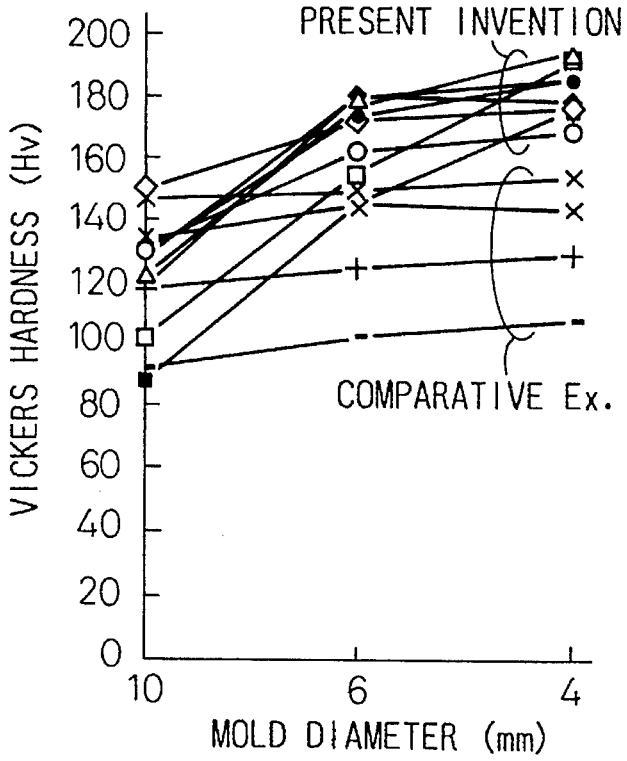
FIG. 4 is a diagram showing the relationship between the mold diameter and the Vickers hardness according to the present invention.

The results of the examples and comparative examples were graphed for each property and are shown in FIGS. 2 to 4. In all the properties, for the compositions of the examples of the present invention, property values are markedly increased when the mold diameter is not more than 6 mm which corresponds to the cooling rate specified in the scope of claim for patent of the present application. By contrast, for the comparative compositions, no significant change in properties is observed even when the mold diameter is reduced. For the compositions of the examples of the present invention, a change in conditions so as to reduce the cooling rate, i.e., the use of a mold having a diameter of not less than 10 mm (conventional mold casting) gives rise to no significant change in properties. That is, for the alloy compositions of the present invention, marked improvements in properties can be attained when the mold diameter is less than 10 mm (cooling rate: not less than 150° C./sec) according to the casting method of the present invention.

Figure 5:
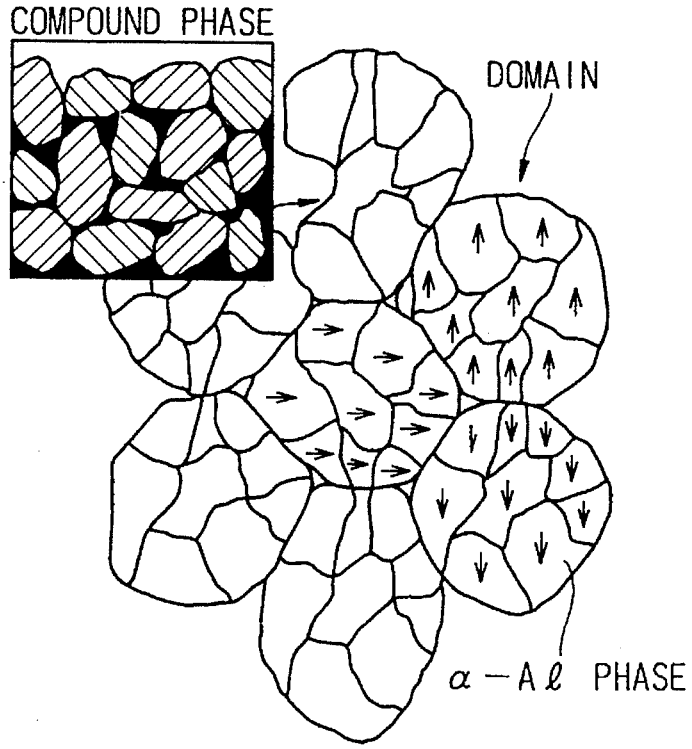
FIG. 5 is a typical diagram of the metallic structure according to the present invention.

Observation of the structure has revealed that, for the material composition of the present invention, the cooling rate specified in the scope of claim for patent of the present application leads to the development of a unique structure which contributes to the improvements in the properties. FIG. 5 shows a schematic diagram of the structure of the alloy of the present invention. The material of the present invention has a fine structure comprising two phases of an α-Al grain phase and a precipitated compound phase, the compound phase surrounding the α-Al phase in a network manner. As a result of detailed observation, it has been found that the α-Al phase forms a domain wherein several to several tens or more grains have the same orientation. The numerous arrows in FIG. 5 indicate the orientation in the domain.

The size of individual grains of α-Al phase is 0.2 to several μm on average which is very small as the size of grains in cast materials. It can be considered that although one domain is originally constituted by one grain (on the order of μm), the preferential precipitation of the compound at subgrain boundaries within grains at the time of solidification results in the formation of the above structure, accelerating the refinement of α-Al phase. When the composition is outside the scope of the claim for patent of the present application, the crystals and precipitates are in conventional forms (dendrite, columnar, equi-axed or other forms depending upon composition and cooling rate) which do not contribute directly to the refinement of α-Al.

EDX analysis by TEM observation has revealed that the compound phase has a composition of Al-Mm (La, Ce, etc.)—M—(O). Oxygen (O) was also detected in the analysis of the matrix, suggesting a possibility that it is a noise. At first sight, this compound looks like an intergranular layer, and the network form contributes to the refinement of α-Al. Observation at high magnification has revealed that, precisely speaking, the compound is in the form of an aggregate of ultrafine (several tens to several hundreds of nm) grains.

Figure 6:
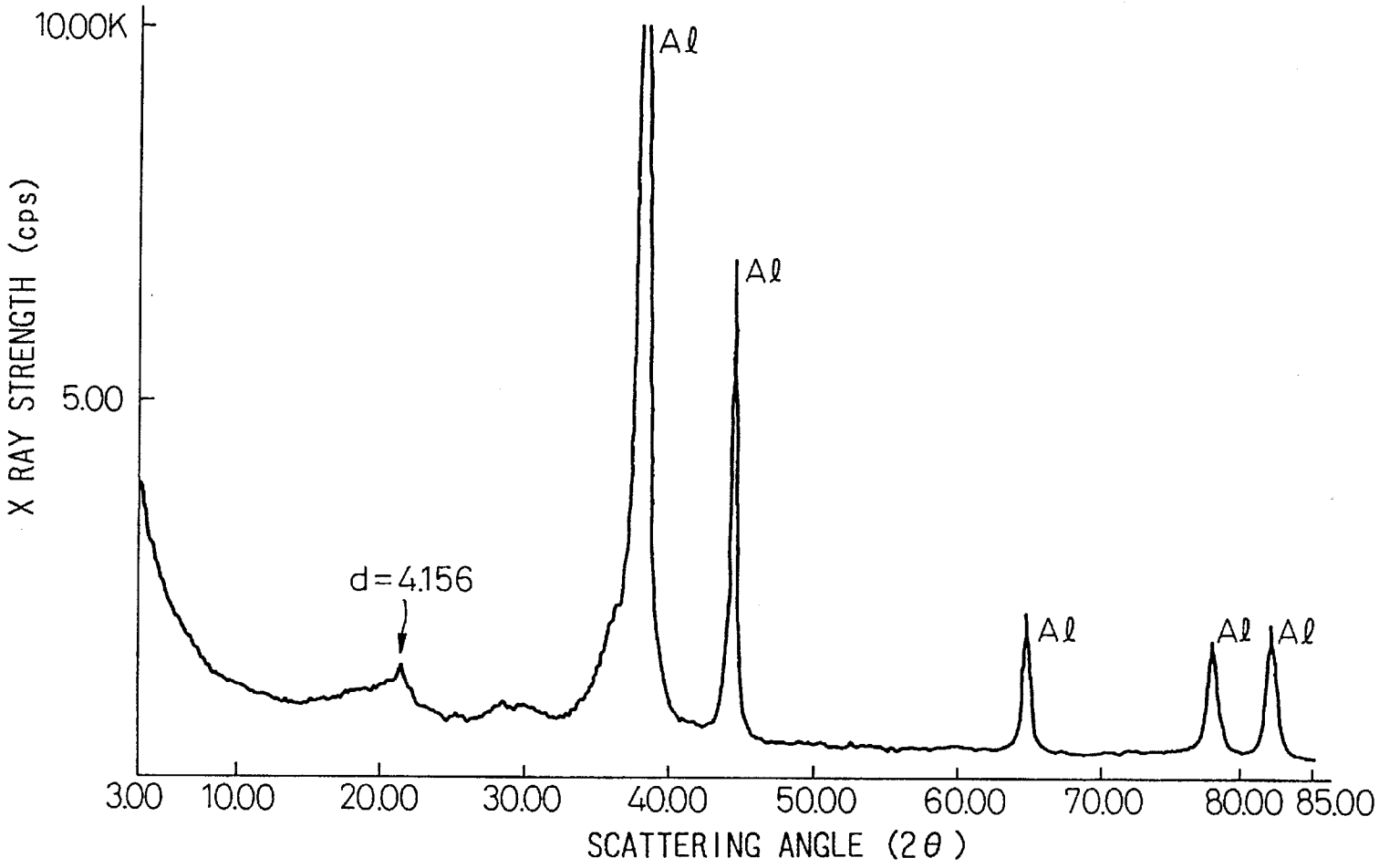
FIG. 6 is a diagram showing an example of the results of X-ray diffraction of the cast material according to the present invention.

The compound was then analyzed by X-ray diffractometry, and the results are shown in FIG. 6. In the X-ray diffraction for the compound, all the peaks observed were derived from Al except for a peak around d value 4.16 Å. Also in electron beam analysis using TEM, only spots corresponding to X-ray diffraction were confirmed, and the phase could not be identified. In the above composition system, however, the compound having a d value in the X-ray analysis was not found in the JCPDS card. These facts show that there is a possibility that the compound constitutes an unprecedented nonequilibrium phase. From the results of electron beam analysis, it was confirmed that the compound had very good coherency with the α-Al matrix.

As described above, the presence of a large amount of precipitates generally improves the strength by precipitation strengthening and composite strengthening but is likely to lower the ductility. In the material of the present invention, however, it is considered that since the precipitate phase is very fine and, in addition, has good coherency with the matrix, high strength can be developed without detriment to ductility.

The crystallized materials, which are outside the scope of the claim for patent of the present application, become equilibrium phases, such as $Al_4Ce$ and $Al_4La$, which, as described above, are different from the material of the present invention in crystallization form and grain diameter.

In the aluminum alloy of the present invention, the precipitate has very good coherency with α-Al matrix, which enables an improvement in strength and an improvement in ductility to be simultaneously attained. This in turn makes it possible to provide, despite the fact that it is a cast material, a high-strength, high-ductility cast aluminum alloy having tensile strength and elongation equal to or higher than elongative materials and a process for producing the same. By virtue of the above advantage, the conventional thermomechanical treatment can be omitted, and a near-net shape product can be directly produced.

What is claimed as new and is desired to be secured by Letters Patent of the United States is:

1. A high-strength, high-ductility cast aluminum alloy, having a structure comprising fine grains of α-Al, having an average grain diameter of not more than 10 μm, surrounded by a network of a compound of Al-lanthanide-base metal, said α-Al grains forming a domain.

2. The high-strength, high-ductility cast aluminum alloy according to claim 1, wherein said domain comprises an aggregate of α-Al grains which have been refined, cleaved, and ordered in a single direction.

3. A high-strength, high-ductility cast aluminum alloy having a composition represented by the general formula $Al_aLn_bM_c$ wherein Ln is at least one metallic element selected from Y, La, Ce, Sm, Nd, Hf, Nb, and Ta, M is at least one metallic element selected from V, Cr, Mn, Fe, Co, Ni, Cu, Zr, Ti, Mo, W, Ca, Li, Mg, and Si and a, b, and c are, in terms of by weight, respectively $75\% \leqq a \leqq 95\%$, $0.5\% \leqq b < 15\%$, and $0.5\% \leqq c < 15\%$, said alloy having a structure comprising fine grains of α-Al, having an average grain diameter of not more than 10 μm, and an ultrafine compound of Al-lanthanide-base metal having an average grain diameter of not more than 1 μm, said α-Al grains being surrounded by a network of said Al-lanthanide-base metal compound and forming a domain.

4. A process for producing a high-strength, high ductility cast aluminum alloy comprising the steps of:

melting an aluminum alloy having a composition represented by the general formula $Al_aLn_bM_c$ wherein Ln is at least one metallic element selected form Y, La, Ce, Sm, Nd, Hf, Nb, and Ta, M is at least one metallic element selected from V, Cr, Mn, Fe, Co, Ni, Cu, Zr, Ti, Mo, W, Ca, Li, Mg, and Si, and a, b, and c are, by weight, respectively, $75\% \leqq a \leqq 95\%$, $0.5\% \leqq b \leqq 15\%$, and $0.5\% \leqq c < 15\%$;

casting the melt into a desired shape; and subsequently cooling the resultant casting at a cooling rate in the range of from not less than 150° to around 350° C./sec.

* * * * *